US009441175B2

(12) United States Patent
Chandaliya et al.

(10) Patent No.: US 9,441,175 B2
(45) Date of Patent: Sep. 13, 2016

(54) PROCESS FOR PRODUCTION OF LOW ASH CLEAN COAL FROM HIGH ASH COAL WITH TOTAL SOLVENT RECOVERY

(75) Inventors: Vimal Kumar Chandaliya, Jamshedpur (IN); Pinakpani Biswas, Jamshedpur (IN); Pradip Kumar Banerjee, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 205 days.

(21) Appl. No.: 14/344,237

(22) PCT Filed: Sep. 4, 2012

(86) PCT No.: PCT/IN2012/000580

§ 371 (c)(1),
(2), (4) Date: Mar. 11, 2014

(87) PCT Pub. No.: WO2013/144972

PCT Pub. Date: Oct. 3, 2013

(65) Prior Publication Data

US 2015/0007494 A1 Jan. 8, 2015

(30) Foreign Application Priority Data

Mar. 28, 2012 (IN) ..... 345/KOL/2012

(51) Int. Cl.
*C10L 5/00* (2006.01)
*C10L 5/04* (2006.01)
(Continued)

(52) U.S. Cl.
CPC .. *C10L 5/04* (2013.01); *C10L 9/02* (2013.01); *C10L 9/08* (2013.01)

(58) Field of Classification Search
CPC ..... C10L 5/04; C10L 9/02; C10L 9/08
USPC ..... 44/627
See application file for complete search history.

(56) References Cited

U.S. PATENT DOCUMENTS 4,272,356 A 6/1981 Stiller et al.
8,262,751 B2 * 9/2012 Biswas ..... C10L 9/00 44/505
2011/0179702 A1 * 7/2011 Biswas ..... B01D 61/145 44/621

FOREIGN PATENT DOCUMENTS

IN 1292/KOL/2006 4/2007
IN 1581/KOL/2008 9/2008
(Continued)

OTHER PUBLICATIONS

Mirza et al., "Extraction of Coals through Dilute Alkaline Hydrolytic Treatment at Low Temperature and Ambient Pressure", Fuel Processing Technology, Apr. 5, 1984, pp. 149-162, vol. 9, Elsevier Science Publishers B. V., Amsterdam.

*Primary Examiner* — Latosha Hines
(74) *Attorney, Agent, or Firm* — The Webb Law Firm

(57) ABSTRACT

A process to produce low ash clean coal from high ash coal with substantially complete solvent recovery, the process including: forming a slurry of coal fines in a N-Methyl-2-pyrrolidone (NMP) and Ethylenediamine (EDA) solution; maintaining said slurry in a reactor at a temperature range of 100° C. to 240° C. and a pressure range of 1 to 4 gauge (kg/cm2) for a period of about 15 minutes to 4 hours; separating the produced sample withdrawn from the reactor, one part being a filtrate and the other a reject; feeding the filtrate into an evaporator to recover 80-85% solvent; precipitating the concentrated filtrate material in an anti-solvent tank to separate coal from solvent; separating the coal by filtration, said separated coal having a reduced ash content; feeding the anti-solvent and solvent mixture into a distillation column to separate remaining solvent from the anti-solvent for reuse in the process.

19 Claims, 1 Drawing Sheet washing system of clean coal and reject

(51) Int. Cl.
*C10L 9/02* (2006.01)
*C10L 9/08* (2006.01)

(56) References Cited

FOREIGN PATENT DOCUMENTS

| | | | | | |
|---|---|---|---|---|---|
| IN | 1088/KOL/2007 | | | 4/2009 | |
| IN | 200701088 | I2 | * | 4/2009 | |
| IN | 1336/KOL/2008 | | | 2/2010 | |
| IN | WO 2010029563 | A1 | * | 3/2010 | ..... C10L 9/00 |
| IN | 611/KOL/2009 | | | 5/2010 | |
| IN | 950/KOL/2009 | | | 1/2011 | |
| IN | 1194/KOL/2009 | | | 10/2012 | |
| JP | 200126791 | A | | 1/2001 | |
| WO | 2010/029563 | A1 | | 3/2010 | |
| WO | 2010/052735 | A1 | | 5/2010 | |

* cited by examiner

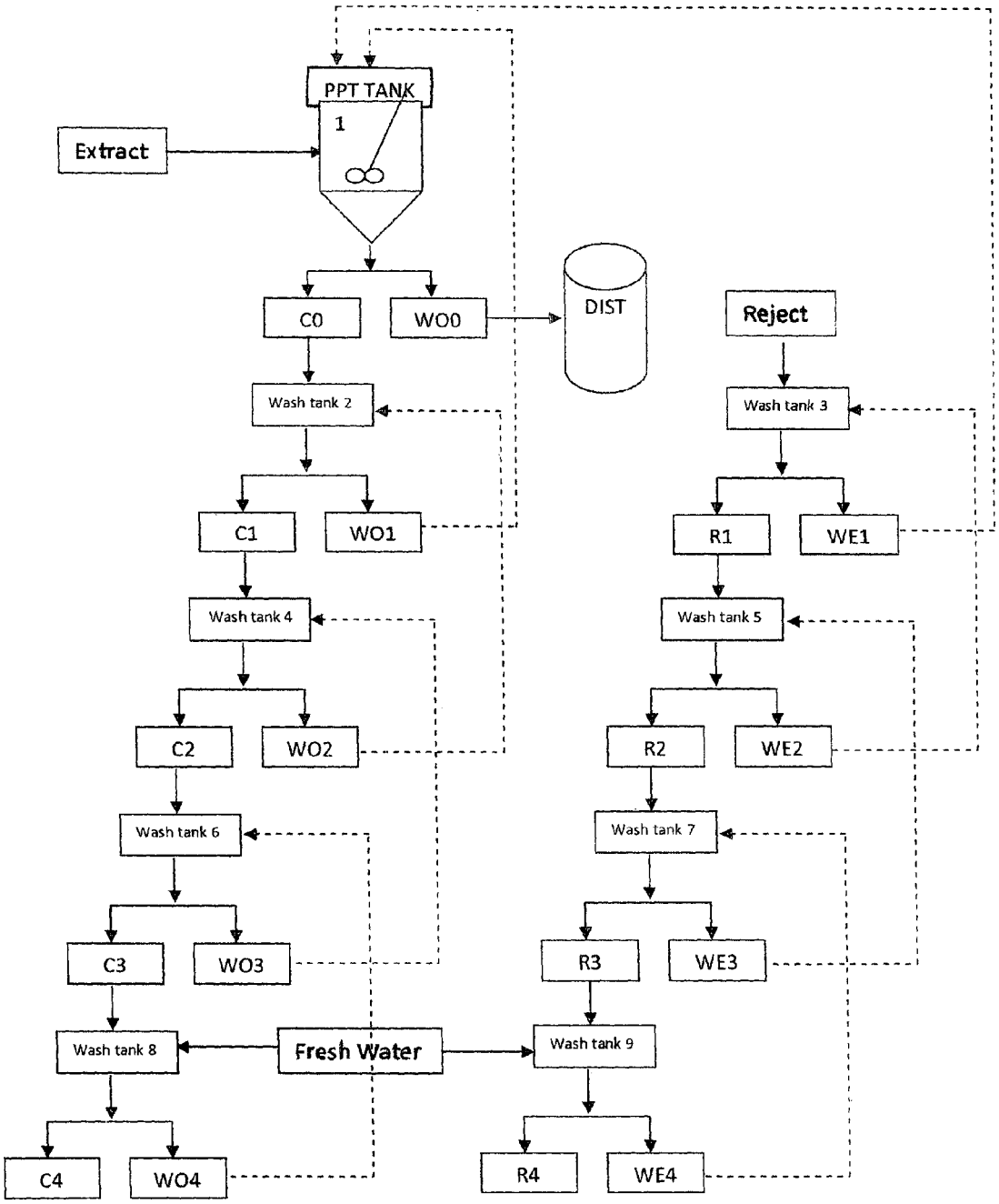
washing system of clean coal and reject

PROCESS FOR PRODUCTION OF LOW ASH CLEAN COAL FROM HIGH ASH COAL WITH TOTAL SOLVENT RECOVERY

CROSS-REFERENCE TO RELATED APPLICATIONS

This application is the United States national phase of International Application No. PCT/IN2012/000580 filed Sep. 4, 2012, and claims priority to Indian Patent Application No. 345/KOL/2012 filed Mar. 28, 2012, the disclosures of which are hereby incorporated in their entirety by reference.

FIELD OF THE INVENTION

An improved way to produce low ash clean coal from high ash coal with total solvent recovery.

BACKGROUND OF THE INVENTION

As coal is a heterogeneous mixture of organic and inorganic constituents, the process of solvolysis of coal varies with its constituents, maturity, and structural characteristics. Since the mineral matter (non-combustible) in coals available in specific geographical location, is very finely disseminated in the organic mass, it is quite difficult to remove this non-combustible mineral matter by conventional physical coal washing techniques. Presence of high percentage of near gravity material in coal makes the scope of gravity process limited. It is known that chemical benefication originates from the limitations of physical beneficiation processes. Broadly, chemical beneficiation is possible by chemical leaching of mineral matter present in coal or, dissolving organic matter of coal in various organic solvents. This indicates that chemical treatment could be one of the solutions to overcome the limitations of physical benefication methods. Prior art teaches chemical beneficiation techniques that employ highly, corrosive chemicals (mostly acids and alkalis). Recovery or regeneration of these chemicals is very important to make this technology viable. A parallel approach towards lowering the ash-content could be recovery of the premium organic matter from coal by solvent refining. Most of the prior art disclose that chemical leaching is basically adapted to produce ultra clean coal or super clean coal with ash content less than 0.2% for various high tech end uses. However, such conventional solvent refining processes do not serve the objective of low ash coal requirement of steel industries because of mainly low recovery which makes the process uneconomic especially when such an ultra clean coal is not absolutely desired at the cost of lowering the yields. Additionally, the operating cost of said prior art process is high because of high cost of solvents and energy requirement in the process. In prior art process, the extraction is being done at boiling point of the solvent mixture making it difficult to recover the solvent from clean coal and reject. Thus, there is a need to propose a process of washing clean coal and reject to recover the remaining solvents. Also, there is a need to develop a process of extraction of coal at a temperature lower than the boiling point of the solvent mix.

By way of reference, the inventors observed that Indian patent application numbers 1292/KOL/06, 1088/KOL/07, 1336/KOL/2008, 950/KOL/09, 1194/KOL/09, 611/KOL/09, 1581/KOL/08 are herein incorporated.

OBJECTS OF THE INVENTION

It is therefore an object of this invention to propose a process to produce low ash clean coal from high ash coal.

Another object of this invention is to propose a process to produce low ash clean coal from high ash coal, in which coal is extracted at higher temperature than the boiling point of solvent.

A still another object of this invention is to propose a process to produce low ash clean coal from high ash coal, in which less amount of solvent is used.

Yet another object of this invention is to propose a process to produce low ash clean coal from high ash coal, in which a washing step to recover solvent from clean coal and reject is implemented.

A further object of this invention is to propose a process to produce low ash clean coal from high ash coal, in which >99% solvent is recovered.

SUMMARY OF THE INVENTION

According to the invention, coal, solvent (N-Methyl-2-Pyrrolidone, NMP) and co-solvent (Ethylenediamine, EDA) are mixed thoroughly to produce coal slurry. The coal slurry is extracted in a known manner which includes coal-solvent mixture. According to the inventive process, coal is extracted by using solvent and co-solvent in the reactor. The coal solvent mixture is separated in a separation unit to produce a coarser fraction and a finer fraction. The finer fraction is fed to an evaporator unit to allow 70 to 80% of solvent recovery. The hot concentrated coal-solvent mixture is then flushed in a precipitation tank to precipitate the coal. Where, water as an anti-solvent is being used. Water separates the solvent from coal and we get water-solvent mixture, which is fed to distillation unit to separate solvent and anti-solvent. And precipitated coal is separated in a filter. In this inventive process, coal, solvent and co-solvent are being taken in a predefined ratio. Coal to solvent ratio is varied from 1:4 to 1:25 (wt/vol, g/mL, coal to solvent ratios are wt/vol and solvent: co-solvent ratios are vol/vol wherever mentioned). Coal to co-solvent ratio is varied from 1:1 to 10:1 and co-solvent to solvent ratio is varied from 1:1 to 1:50 (g/mL). Both clean coal and reject is being washed in a sequence shown in FIG. 1. Following important equipments were there in the system, such as thermic fluid heater, reactor, heat exchanger, thermic fluid pump, inert gas ($N_2$) cylinder, feed tank for evaporator, double effect evaporator, feed pump, transfer pump, discharge pump, heat exchanger, condenser, cooling tower, cooling pump, concentrate tank, condensate tank, distillation feed tank, feed pump, distillation column, condenser, condenser tank, reflux pump, reboiler, reboiler pump, discharge pump, and bottom product tank. Some other equipments or vessels such as water storage tank, diesel storage tank, thermic fluid storage tank, expansion tank and centrifuge filter were also installed for this process.

BRIEF DESCRIPTION OF THE ACCOMPANYING DRAWING

FIG. 1 shows a system for washing clean coal and rejects.

DETAILED DESCRIPTION OF THE INVENTION

As shown in FIG. 1, the system consists of a plurality of units, each unit comprising a precipitation tank, and a wash tank with stirrer system. Coal (reject or clean coal) and washed liquid is obtained from each unit. The coal and reject goes to next wash tank and washed liquid goes to previous wash tank.

Coal and solvent in predetermined ratio are loaded into a reactor. Nitrogen gas is supplied through $N_2$ cylinder for maintaining inert environment. Diesel is supplied to a burner from a diesel storage tank. Thermic fluid is supplied into the system from a thermic fluid storage tank. The thermic fluid is heated in a thermic fluid heater. On heating, the thermic fluid's volume increases, and accordingly, an expansion tank is used to store the extra thermic fluid. Hot thermic fluid is pumped by a thermic fluid pump to heat the reactor. During extraction, a sample is withdrawn from a sample port. On completion of the extraction, the burner is switched off. To cool down the thermic fluid heater, the thermic fluid is passed through a heat exchanger. Water is pumped in the heat exchanger through a water pump from a water storage tank. A reflux condenser maintains pressure and temperature at the reactor at a desired level.

Coal and solvents are loaded into the reactor in a predetermined ratio. Coal to total solvent ratio is varied from 1:4 to 1:25 (wt/vol, g/mL, coal to solvent ratios are wt/vol and solvent: co-solvent ratios are vol/vol wherever mentioned). Co-solvent to solvent ratio is varied from 1:50 to 1:1. Nitrogen gas is purged into the system for maintaining an inert environment. Thermic fluid is pumped into the system from the thermic fluid storage tank. Thermic fluid is heated in the thermic fluid heater by the diesel fired burner. The reactor is heated by hot thermic fluid. Reactor pressure is varied from 1 to 4 $kg/cm^2$. Reactor temperature is varied from 100° C. to 240° C. Extraction is done for 15 minutes to 4 h in the reactor.

Sample is withdrawn from the reactor through the sample port in predetermined time intervals. This sample is filtered through a mesh. Filtration separates the refluxed mix in two parts (i) reject and (ii) filtrate (extracted material with solvents). Reject is washed thoroughly with an anti-solvent (water) for the removal of the solvents from the reject. After drying and weighing, these rejects are subjected to ash analysis. The filtrate is actually the extract containing very low ash coal. For precipitation an anti solvent (water) is taken in a vessel. Concentrated extract is then added in to the water. As these solvents are soluble in water, the solvents move to water phase. It resulted in precipitation of solid coal particles. The precipitated coal is then separated from the solvent-water solution through filtration. This step is carried out in a conical flask-funnel type arrangement with standard mesh. The reject of this filtration is the low ash clean coal; filtrate consists of water and the solvents. After drying and weighing, the clean coals are subjected to chemical and petro graphical analysis.

At a plant level, the recovery system comprises an evaporator feed tank, an evaporator feed pump, a first evaporator, a vapour collector, a second evaporator, a transfer pump, a discharge pump, a heat Exchanger, a concentrate product tank, a condenser, a condensate tank, a cooling tower, a cooling pump, a feed tank for distillation column, a feed pump for distillation, a distillation column, a condenser, a condensate tank, a distillate pump, a reboiler, a reboiler pump, a bottom product tank.

Reacted material in the reactor is taken out and filtered through a centrifuge filter. Filtration separates the refluxed mix in two parts (i) reject and (ii) filtrate (extracted material with solvents). Reject is washed thoroughly with an anti-solvent (water) for the removal of the solvents from the reject (as shown in FIG. 1). After drying and weighing, these rejects are subjected to ash analysis. The filtrate is actually the extract containing very low ash coal. Filtrate (extracted material along with solvents) are taken into the evaporator feed tank. Feed material is fed to both the evaporators through the feed pump. Heating is started in the second tank through hot thermic fluid. As the material is heated in the second evaporator, vapour is generated. Vapour passes through the vapour collector tank and then goes to the first evaporator to pre heat the input material. Vapour generated in the first evaporator passes through the vapour collector and finally passes through the condenser. The condensate is collected in the condensate tank. The discharge pump is activated to allow discharge of the concentrated material through the discharge pump to the concentrate product tank with or without cooling. Concentrated product is continuously taken out into the concentrate product tank. This cycle is allowed to continue till a substantially concentrate material is obtained. About 80-85% solvent is evaporated in this evaporator.

The concentrated material is precipitated in water in the mixing tank. As these solvents are soluble in water, solvents move to water phase. It resulted in precipitation of solid coal particles. Thus, precipitated coal is then separated from solvent-water solution through the centrifuge filter. Clean coal is further washed (as shown in FIG. 1) till all the solvent is removed from coal. Water-solvent mixture is stored in a storage tank, which is separated in a distillation column.

Water-solvent mixture is fed to the distillation feed tank. The feed pump is started to feed the material into the distillation column. The reboiler pump is started to allow flow of thermic fluid in the reboiler to heat the material. This water-solvent mixture is heated up by circulating it through the reboiler. After some time this whole material is heated up and water vapour is generated. This vapour comes out from top vapour line. The reflux (distillate) pump is started to recycle the distillate into the distillation column. Vapour passes through the condenser and condensed water goes to the distillate tank. This distillate is fed to the distillation column till an equilibrium is achieved (based on reflux ratio). The top product (distillate) can be taken out from the distillate line. This continuous cycle of feeding material to the distillation column, heating it through the reboiler and recycling it through the condenser continuous till the feed material is distillated.

The bottom product discharge pump is operated to collect the bottom product into the bottom product tank. Water and solvent is separated and stored in different tanks, which can be used again in the process.

Clean coal and reject coal is washed as shown in the FIG. 1. Basically, it is a countercurrent washing where fresh water is used, to wash last batch of clean coal and reject (least contaminated with solvents) in the wash tank 8 and 9. Coal extract along with wash liquid WO1 and WE1 is fed to precipitation tank (PPT TANK 1). Coal is precipitated and clean coal (C0) and wash liquid (WO0) are obtained. The clean coal is fed to next wash tank 2, and wash liquid WO0 to distillation column, where water and solvent is separated. In the wash tank 2 clean coal C0 and wash liquid WO2 is fed, which gives clean coal C1 and wash liquid WO1. Clean coal C1 and wash liquid WO3 is fed to wash tank 4, which gives clean coal C2 and wash liquid WO2. Clean coal C2 and wash liquid WO4 is fed to wash tank 6, which gives clean coal C3 and wash liquid WO3. Clean coal C3 and fresh water is fed to wash tank 8, which gives clean coal C4 and wash liquid WO4. Reject along with WE2 is fed to wash tank 3, which gives reject R1 and wash liquid WE1. Reject R1 and wash liquid WE1. Reject R1 along with WE3 is fed to wash tank 5, which gives reject R2 and wash liquid WE2. Reject R2 along with WE4 is being fed to wash tank 7, which gives reject R3 and wash liquid WE3. Reject R3 along fresh water is fed to wash tank 9, which gives reject R4 and wash liquid WE4. Fresh water is given only at one stage and the same water is used in all other steps in washing. By this strategy, water consumption is less compared to conventional washing.

Many trials were conducted by varying different process parameters such as temperature (100° C. to 240° C.), coal to solvent ratio (1:4 to 1:25), size fraction (−1 mm, to −0.1 mm), different coal origin, filter pore size, co-solvent to solvent ratio. The typical feed coal samples were run-of-mines (ROM) coal and flotation clean coal having about 25-35% and 12-15% ash respectively. The feed particle size varied from −1 mm to −0.1 mm and extraction was done at different temperature.

Some of the typical results are shown here, for example, clean coal yield varied from 45% to 60%. Clean coal ash was about 4%. It is possible to produce less than 8% ash clean coal with 60% yield and about 80% combustible recovery with this process. With the help of fine filtration even less than 1% ash clean coal could be possible. With some typical coal, 70% of clean coal yield could be achieved.

We claim:

1. An improved process to produce low ash clean coal from high ash coal with substantially complete solvent recovery, the process comprising:

(i) forming a slurry of coal fines in a solvent solution comprising N-Methyl-2-pyrrolidone (NMP) and Ethylenediamine (EDA);

(ii) maintaining said slurry in a reactor at a temperature range of 100° C. to 240° C. and a pressure range of 1 to 4 gauge (kg/cm$^2$) for a period of about 15 minutes to 4 hours;

(iii) separating the produced slurry after withdrawal from the reactor, separation cut size being variable depending on the particle size to be treated including application of the end product, a first part of the separated sample being a filtrate and a second part being a reject;

(iv) washing the reject in an anti-solvent by adding the reject to form a reject-anti-solvent mixture;

(v) separating the reject-anti-solvent mixture by filtration, said separated reject having a high ash content;

(vi) feeding the filtrate into an evaporator to recover 80-85% solvent and form a concentrated filtrate;

(vii) precipitating the concentrated filtrate in an anti-solvent tank to separate coal from solvent;

(viii) separating the concentrated filtrate-anti-solvent solution into coal and an anti-solvent and solvent mixture by filtration, said separated coal having a reduced ash content;

(ix) feeding the anti-solvent and solvent mixture into a distillation column to separate remaining solvent from the anti-solvent for reuse in the process; and (x) washing the separated coal in anti-solvent in at least two different coal washing tanks, wherein fresh anti-solvent is supplied to a final coal washing tank and is then supplied in a countercurrent direction from the final coal washing tank to an initial coal washing tank through any intermediate coal washing tanks that are present between the final coal washing tank and the initial coal washing tank.

2. The process as claimed in claim 1, wherein said coal comprises run of mine coal.

3. The process as claimed in claim 1, wherein said coal comprises flotation clean coal.

4. The process as claimed in claim 2, wherein said coal particle size is −0.5 mm or finer.

5. The process as claimed in claim 1, wherein an ultra low ash clean coal or super clean coal produced in step (viii) has an ash content of ≤1%, and is produced by fine filtration of the filtrate.

6. The process as claimed in claim 5, wherein said ultra low ash clean coal or super clean coal having an ash content of <1% is applicable to produce graphite, liquid fuels, aromatic polymers, special chemicals, and carbon materials.

7. The process as claimed in claim 1, wherein a moderate ash clean coal produced at step (iii) has an ash content of <8%, and is produced by coarse filtration of the filtrate.

8. The process as claimed in claim 7, wherein said moderate ash clean coal having an ash content of <8% can be used for coke making and blast furnace injection in iron and steel industries and in power generation.

9. The process as claimed in claim 1, wherein moderate ash clean coal having an ash content of <8% produced in the process constitutes about 60% clean coal yield.

10. The process as claimed in claim 1, wherein coal having an ash content of <8% is produced in the process and contains about 80% combustible recovery in the clean coal.

11. The process as claimed in claim 1, wherein coal having an ash content of <8% is produced in said process at a coal to solvent ratio of 1:4 to 1:25.

12. The process as claimed in claim 1, wherein coal having an ash content of <8% is produced in said process at an EDA to NMP ratio of 1:1 to 1:50.

13. The process as claimed in claim 1, wherein coal having an ash content of <8% is produced in said process at a temperature range of 100° C. to 240° C.

14. The process as claimed in claim 1, wherein coal having an ash content of <8% is produced in said process at a pressure range of 1 to 4 gauge (kg/cm$^2$).

15. The process as claimed in claim 1, wherein coal having an ash content of <8% is produced in said process at a coal to EDA ratio of 1:1 to 10:1.

16. The process as claimed in claim 1, wherein coal having an ash content of <8% is produced with >99% solvent recovery from the system.

17. The process as claimed in claim 1, wherein coal having an ash content of <8% is produced in said process wherein clean coal and reject are being washed in at least five stages to recover the solvents.

18. The process as claimed in claim 1, wherein, in step (iv), the reject is washed in anti-solvent in at least two different reject washing tanks and wherein fresh anti-solvent is supplied to a final reject washing tank and is then supplied in a countercurrent direction from the final reject washing tank to an initial reject washing tank through any intermediate reject washing tanks that are present between the final reject washing tank and the initial reject washing tank.

19. The process as claimed in claim 18, wherein the anti-solvent used in step (vii) to precipitate the concentrated filtrate is supplied from the initial coal wash tank and the initial reject wash tank.

* * * * *